United States Patent [19]

Tao

[11] Patent Number: 4,572,440

[45] Date of Patent: Feb. 25, 1986

[54] FIBER MOISTURE CONTROL IN THE FORMATION OF DRY-LAID WEBS

[75] Inventor: Thomas Tao, Neenah, Wis.

[73] Assignee: James River-Dixie/Northern, Inc., Conn.

[21] Appl. No.: 274,804

[22] Filed: Jun. 18, 1981

[51] Int. Cl.[4] ..... B02C 19/12

[52] U.S. Cl. ..... 241/23; 241/28; 241/33; 241/65

[58] Field of Search ..... 241/30, 33, 41, 60, 241/61, 62, 80, 97, 189 R, 15, 18, 21, 28, 23, 65

[56] References Cited

U.S. PATENT DOCUMENTS

| | | | |
|---|---|---|---|
| 2,008,892 | 7/1935 | Asplund . | |
| 2,807,054 | 9/1957 | Burger et al. . | |
| 3,903,229 | 9/1975 | Mark . | |
| 3,987,968 | 10/1976 | Moore et al. | 241/28 |
| 4,118,832 | 10/1978 | Addy et al. . | |
| 4,136,831 | 1/1979 | Cederquist et al. . | |
| 4,148,439 | 4/1979 | Floden | 241/28 |
| 4,241,881 | 12/1980 | Laumer | 241/28 |

OTHER PUBLICATIONS

Wink, *The Effects of Relative Humidity and Temperature on Paper Properties*, TAPPI, vol. 44, No. 6, pp. 171A–178A, 6–1962.

*Primary Examiner*—Mark Rosenbaum

*Attorney, Agent, or Firm*—Finnegan, Henderson, Farabow, Garrett & Dunner

[57] ABSTRACT

A method of and apparatus for forming an air laid, e.g., dry laid, fibrous web comprising the steps of and apparatus for defiberizing wood pulp laps, rolls or bales, preferably in a hammermill; transporting the fibers pneumatically to a forming head, and dispensing said fibers onto a foraminous support means, the aforesaid operations being carried out at conditions of high humidity such that the average fiber moisture content is at least above 2.5% by weight just prior reaching a forming header. In the preferred embodiment air at between about 150° to about 200° F. and having a relative humidity of between about 75 to 95% is introduced to the defiberizer to provide the requisite air moisture content. If desired over large fibers from the forming head may be recycled to the defiberizer. By practicing the invention, electrostatic charges on the fibers are reduced thereby minimizing clumping and ensuring better formation.

19 Claims, 3 Drawing Figures

FIBER MOISTURE CONTROL IN THE FORMATION OF DRY-LAID WEBS

FIELD OF INVENTION

The invention relates to a method of forming cellulosic webs with dry fibers of optimum moisture content. More specifically, the invention pertains to the control of humidity conditions within the defiberizing means and the fiber transport line to effect optimization of fiber moisture content.

BACKGROUND OF INVENTION

Cellulosic fibrous webs, particularly such webs associated with the manufacture of paper products, are formed by dispensing fibers randomly from a distributor or forming header onto a moving foraminous support means, generally a Fourdrinier wire. Three distinct methods of dispensing the fibers are in use currently. In the wet laid method, an aqueous slurry of said fibers is dispensed onto the wire, while in a variation of this process, an aqueous foamed dispersion comprising a high percentage of air by volume is dispensed. In the third general method, which method is the subject of the present invention, dry fibers are transported pneumatically to the forming header and dispensed onto the wire.

The fibers used in dry forming the web are first defiberized to proper freeness from pulp rolls, laps or bales, generally in a hammermill or equivalent defiberizing device. During this step mechanical energy from the rotors is converted into heat energy, the heat being transferred to the fibers whereby their moisture content is reduced appreciably. Low fiber moisture content compounds the difficulty of obtaining good quality product because the over-dry fibers tend to cling together as clumps while airborne due to electric static charges thereupon. These static charges are also undesirable because of the explosion dangers they pose. Finally, low and uncontrolled fiber moisture content is known to compromise the formation quality and caliper uniformity of webs obtained by the dry-laid process.

Two methods of overcoming the inherent problem of low fiber moisture, alone or in combination, have been used. The first method provides for pretreatment of the fibers with chemical antistatic agents or water before difiberization, but at high energy related costs and at the expense of product quality. The second method contemplates control of the humidity in the forming environment, typically a confined room. This second method is expensive because large volumes of air must be pretreated and distributed within the room with large lag times between set point humidity and the actual humidity therein.

Hence, there is need for a cost efficient easily controllable method for not only preventing excessive moisture loss of the fibers, but also to ensure an optimum moisture content.

SUMMARY OF INVENTION

It is an object of this invention to prevent excessive moisture loss in fibers during comminution preceding their use in dry forming air-laid cellulosic fibrous webs.

It is a primary object of this invention to control the amount of moisture in fibers transferred pneumatically to the forming header in a dry-laid system for manufacturing fibrous webs.

It is a further object of this invention to optimize the moisture content of the fibers entering the forming header. This optimized fiber moisture content is desirable in achieving quality webs of good integrity and uniform caliper.

Collaterally, an additional object of this invention is to eliminate the static charge problems inherent with pneumatic transport of dry fibrous materials thereby ensuring uniformity of web formation and a concommitant reduction in explosion potential.

These and other objects and advantages of the present invention will be readily appreciated upon an examination of the drawings, the claims, and the description of invention, a summary of which follows.

The essential feature of the preferred embodiment of the present invention is to introduce humidified air at a controlled relative humidity and temperature into the defiberizing means, typically a hammermill, thereby substantially decreasing the driving force towards disorption equilibrium fiber moisture content at defiberizing conditions. The comminuted fibers are then transported pneumatically to the forming header by blower means, the transport air being preferably the air supplied to the defiberizer. A temperature drop between about 20° to 50° F. occurs along the transport line so that temperature control means are provided to prevent transport line condensation from occurring, which would undesireably wet the fibers. The relative humidity in the transport line can be controlled by resetting the defiberizer inlet air moisture content.

DETAILED DESCRIPTION OF INVENTION

Figure 1:
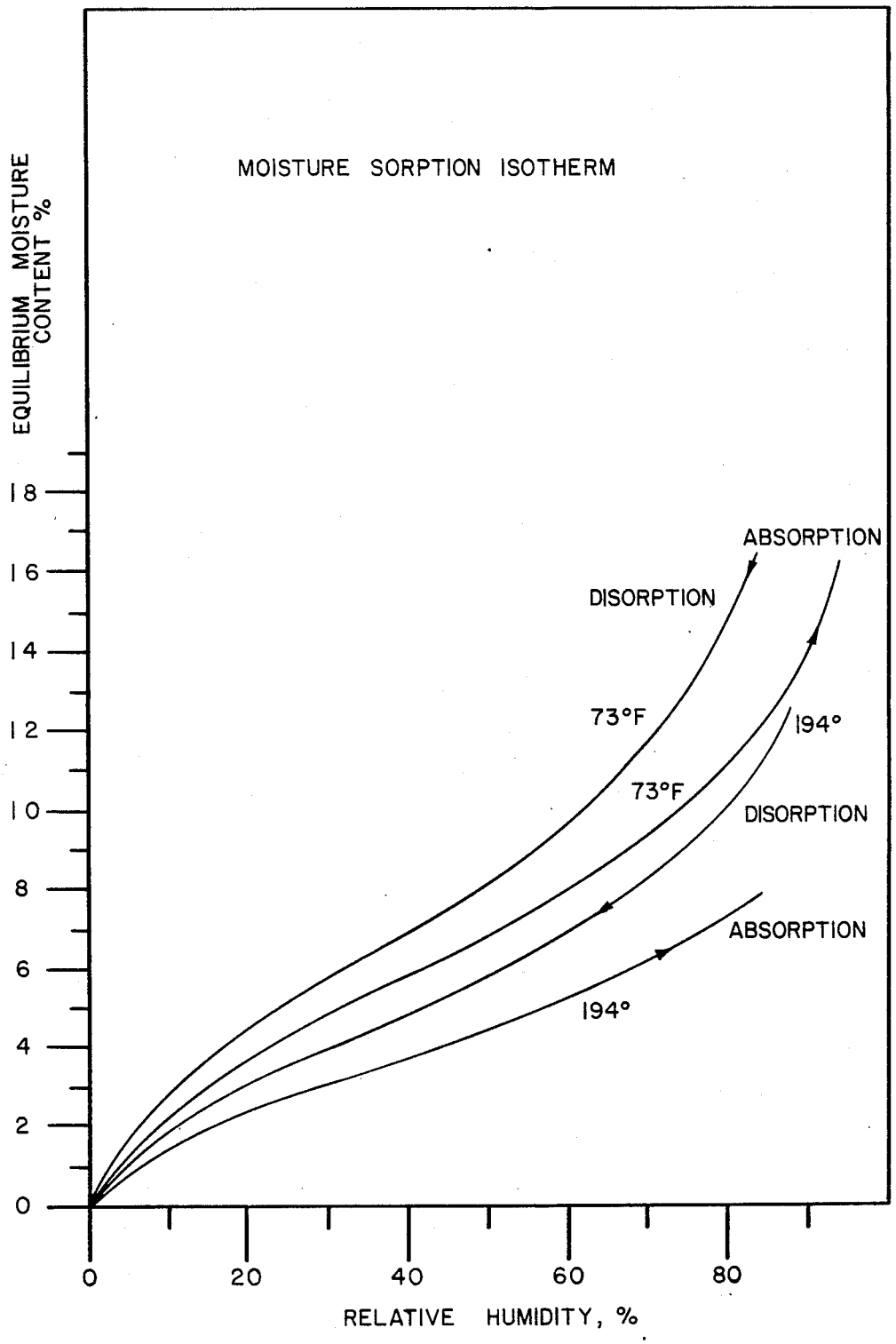
FIG. 1 is a moisture sorption isotherm for West Coast softwood bleached kraft, and is typical of such isotherms for paper-making wood fibers.

Referring to FIG. 1, a graph representing the Moisture Sorption Isotherm for a typical softwood bleached kraft pulp, which appears in Wink, *The Effect of Relative Humidity and Temperature on Paper Properties,* TAPPI, Vol. 44, No. 6, P. 171A (June 1961), shows that storage of wood fibers at about 73° F. results in an equilibrium moisture content of between about 4 to 10% by weight, these values corresponding to normal atmosphere relative humidity (R.H.) averaging between about 20 to 70%, respectively. Under prolonged abnormal humidity conditions, the moisture content of stored wood fibers may be outside the stated range. Of course, it is to be realized that each fiber species will have a different isotherm, and that the Isotherm of FIG. 1 is used illustratively. From the graph it will be observed that these wood fibers at 73° F. will finally disorb to an equilibrium moisture content of about 2.8% if stored in an atmosphere of 10% relative humidity, and will not adsorb additional moisture until the humidity has increased to above about 14%. Further, the rate at which moisture is regained is somewhat lower, the slope of the adsorption curve being less than that of the disorption curve. Proceeding up the adsorption curve, at 60% R.H. a moisture content of 8% is obtained, said moisture not being lost until the R.H. falls to below about 50%. If the fibers are defiberized at a temperature of 194° F., the isotherm of FIG. 1 indicates that the moisture content cannot fall below 5% until the R.H. decreases to below 25%; or below 3% until the R.H. decreases to less than about 12%.

In the conventional process, whether or not containing the features hereinbefore described under BACKGROUND OF INVENTION, transport air at ambient conditions is introduced to the defiberizing device, generally along with a pneumatically transported stream of over large fibers recycled from the forming header. The ambient air thus introduced has typically a temperature of about 70° F. and an R.H. of about 70% which corresponds to about 0.011 pounds of water vapor per pound of dry air. The returned fibers recycled from the forming header are maintained in an environment of approximately 80° F. and about 50% R.H., the transport air therefor also having about 0.011 pounds of water vapor per pound of air. The outlet fiber stream exiting the defiberizer, and, taking into account the temperature increase therein of about 80° to 125° F., has a relative humidity of less than 5%, often less than about 3%. Hence, from FIG. 1 the moisture content of the fibers would be less than about 1.9%, typically about 1.5% at equilibrium. Actual moisture content is somewhat higher, i.e., between about 1.5% and 2.5%, at less than 100% of equilibrium. As the temperature of the stream leaving the defiberizer drops in the transfer line, R.H. increases, but to less than 25%, generally around 15 to 20%. Again referring to FIG. 1, the maximum moisture regain that can be obtained is to about 3.0% by weight of the fibers, and, under actual non-equilibrium conditions, is less than 3.0% usually less than 2.5%.

Figure 2:
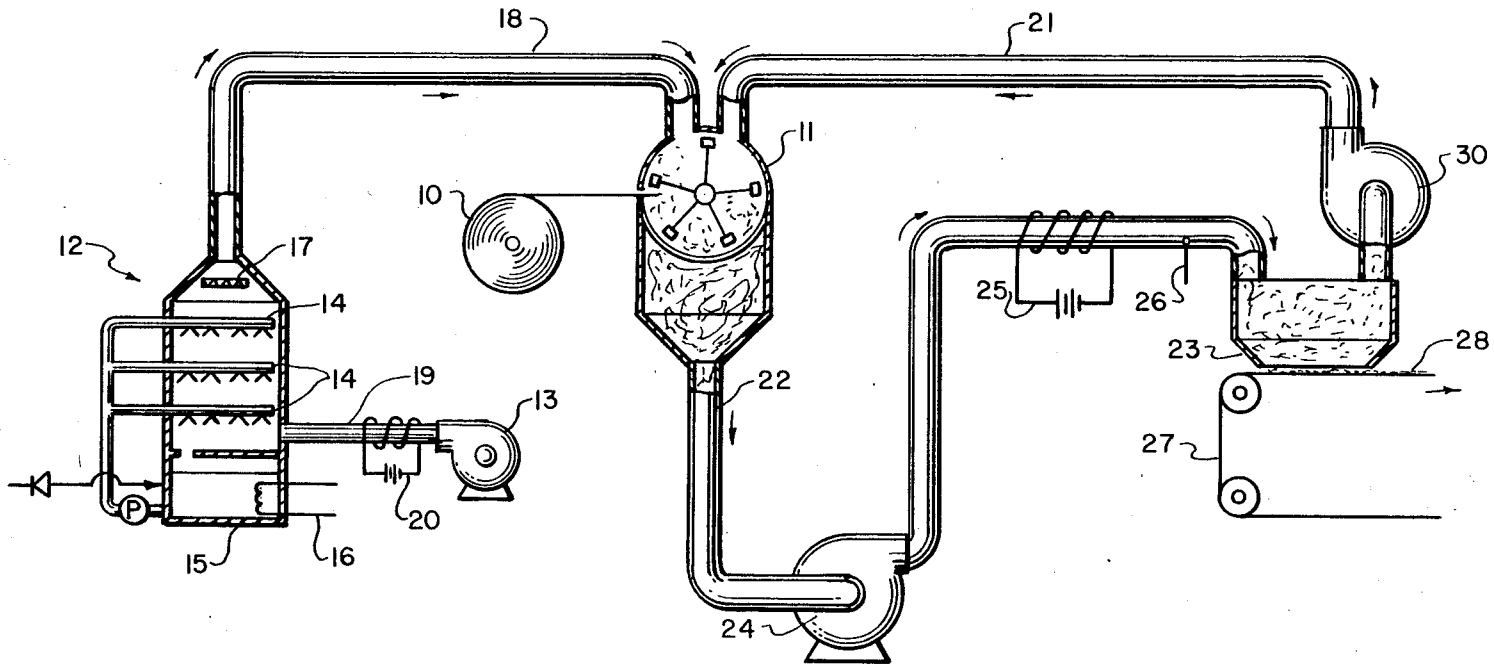
FIG. 2 is a flow diagram of the process.

The process of this invention is illustrated in FIG. 2. Pulp bales laps or rolls 10 are fed into the defiberizer 11, and shredded into individual fibers approximately one to four mm. in length. While the preferred defiberizer is a hammermill, other means may be used as are known in the art, such other means including a lickering roll defiberizer, a pin roll defiberizer, or a disc refiner. Ambient air is introduced into humidification means 12 through duct 19 by means of a blower 13, the air contacting a series of water sprays designated by numeral 14. Air inlet temperature to means 12 is controlled by heating means 20. Conversely, water temperature, maintained by constant water temperature tank 15, can be regulated by heat exchanger 16 as will be more fully explained below. The water laden air leaves the humidifier 12 in outlet duct 18 for transfer to defiberizer 11. Water droplets are eliminated by demisting means, e.g., demisting pads, chevron baffles and the like, 17. Air leaves the humidifier in excess of 75% humidity, and at about 150° to about 200° F., thus carrying relatively large quanties of water vapor to the defiberizer. Preferably, the air temperature is slightly below the defiberizer steady state temperature, which operates at between about 150° to about 210° F., and the R.H. therein is between 80 and 95%.

Figure 3:
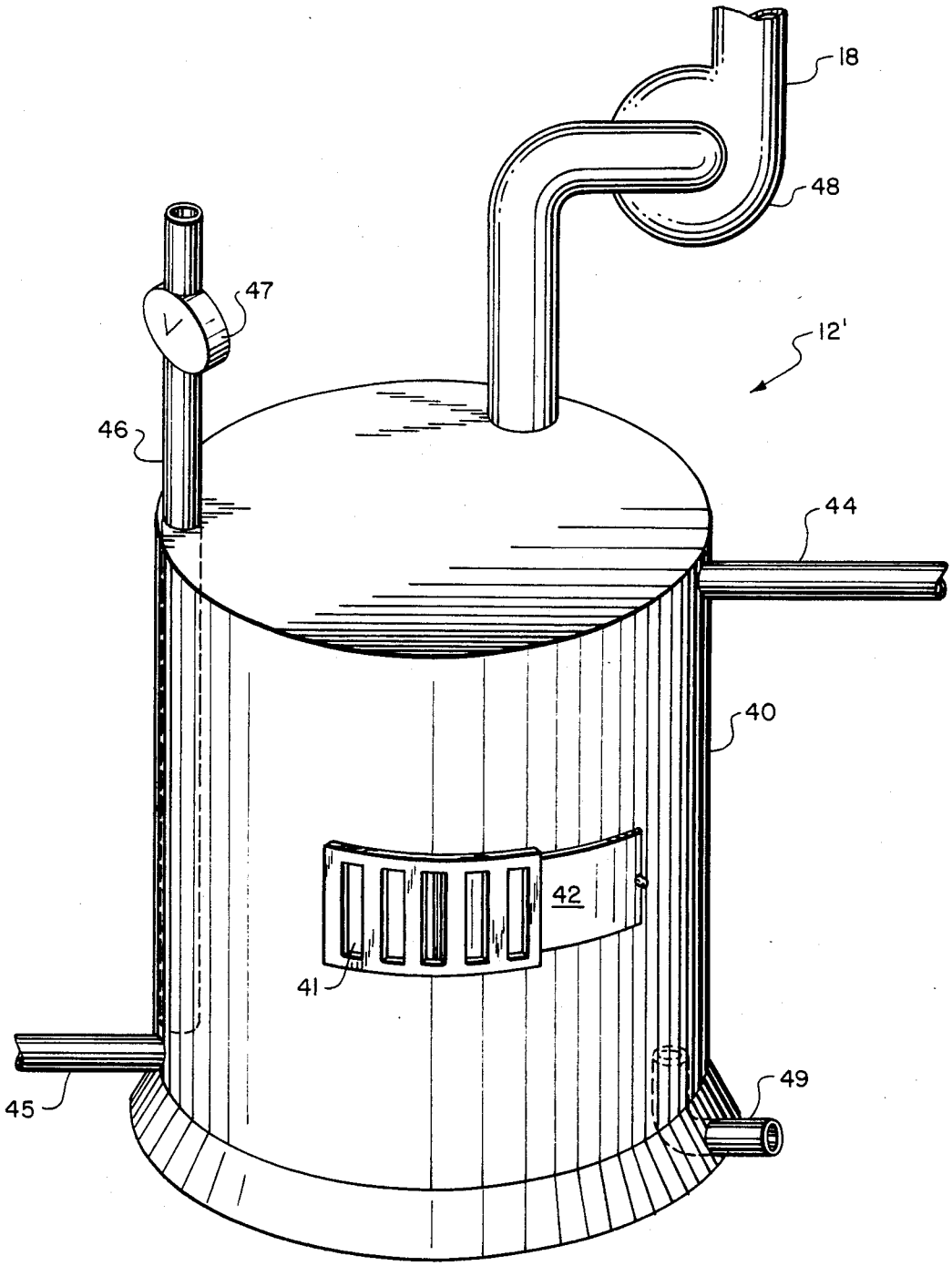
FIG. 3 is one embodiment of a humidifier that may be used in the process.

One humidifier 12 that may be adapted for use with the present process is the Aero-washer manufactured by Buffalo Forge Company The humidifier 12' illustrated in FIG. 3 may also be used to obtain the highly humid air to defiberizer 11 via duct 18. This embodiment comprises a jacketed tank 40 having air intake means 41 provided with damper 42. Saturated steam enters the tank 40 through steam line 46 equipped with control valve 47. Cooling water circulates through the jacket (not shown), entering via inlet 44 and leaving via outlet 45. Air entering the tank is heated to process temperature by the steam, a portion of the steam condensing thereby, and by the cooling obtained by the cooling water. Condensate leaves the tank through outlet 49. Collaterally, the air leaving the tank through line 18 and blower 48 has picked up requisite amount of water vapor, the amount thereof being regulated by the steam process and flow conditions and/or by the cooling water process and flow conditions as is explained below. Blower 48, while shown in line 18, may also be installed in an air feed line to the tank 40.

Recycled fibers from the forming header 23 are carried through duct 21 by blower 30 to the defiberizer 11, the transport air quality therein preferably being consistent with the values in the conventional art, The quantity of recycled fibers is typically small being about 0.001 to about 0.01 pounds per ACFM of transport air. However, the ratio of recycled air 21 to make-up air 18 on an actual volume basis is about 12:1 to about 5:1. Alternatively, it is within the scope of this invention to increase temperature and/or relative humidity of the recycle air in lieu of or in addition to make-up air humidification. These alternates are not preferred because of the larger quantities of air that would have to be treated.

At steady state operation of the process, the temperature in the defiberizer is between 150° to about 210° F., and is dependent primarily on the amount of mechanical energy dissipated as well as on the heat introduced by the inlet air stream. Preferred operating temperatures range between 160° and 200° F. At the temperature and water vapor concentration in the defiberizer 11, the R.H. ranges between 5 and 30%, typically between 5 and 10%. As discussed above, the increase in R.H. in the defiberizer raises the lower limit of equilibrium fiber moisture content. More importantly, the driving force towards disorption equilibrium is reduced.

The fibers are transported by the air pneumatically from the defiberizer 11 through duct 22 to forming head 23. An in-line blower 24 supplies the requisite motive energy for this transfer. Heat dissipation from the bare duct 22 to the atmosphere lowers the temperature of the air-fiber stream about 20° to 50° F. However, because R.H. increases as temperature decreases, an overly large temperature drop will saturate the air causing condensation therein. This must be avoided because such condensation will wet the fibers resulting in poor forming of the web. For this reason in-line temperature control means 25 is installed to maintain a temperature at the forming header sufficient to keep all moisture in vapor form.

Having fixed the steady state operating conditions, it is also preferable to control the heat content and moisture content of the humidified inlet air, stream 18. This is done by R.H. control at the temperature in duct 22 just upstream of the forming header. Sensing means 26 measures the R.H. of the air stream 22, deviations from the set point causing adjustment to the air inlet temperature in duct 19 by changing the heat transferred through exchanger 16. For optimal flexibility, it is also possible to provide cascade control whereby the heat exchangers 16, 20 are on a split range as is conventional in the art. As is readily understood, the aforesaid control system may also be adapted for use with the humidifier 12' shown in FIG. 3.

By use of the above described method, the moisture content of fibers to the forming header will be greater than 3%, preferably greater than 5%. In addition, supplemental moisture adsorption by the fibers will occur in the transfer duct 22 as temperature decreases and as R.H. increases, although this is regarded as a secondary benefit in view of the primary moisture preservation effect previously described. Foraminous support and fiber transport means 27 are used to carry the dispersed fibrous web-forming fibers 28 from the forming header area.

As an illustration of these principles, the following Examples compare conventional practice with the method of the present invention.

EXAMPLE I

In a pilot plant air laid defiberizing unit of conventional design, 2.7 lbs. of pulp per minute were defiberized in a hammermill. The pulp had a 6.7% fiber moisture content, i.e., 0.181 lbs. of water per minute were introduced to the hammermill in association with the fibers. A make-up air stream at 70° F. and having a relative humidity of 70% was introduced to the hammermill at a rate of 70 ACFM. Recycle fibers were also added to the hammermill, the transport air therefor being at 80° F. and 50% R.H., and at a flow rate of 400 ACFM. The water vapor associated with the make-up and recycle air streams was calculated at 0.057 lbs./min. and 0.3223 lbs./min., respectively. Hence, the total water concentration in the hammermill was 0.5603 lbs./min.

The air temperature exiting the hammermill was 175° F. and the flow rate about 559 ACFM. At this temperature, the air R.H. was 3.12%. Just prior to the former, the air temperature had decreased to 120° F. with a corresponding increase in R.H. to 20.3%. The flow rate was calculated to be 510.6 ACFM. The moisture content of the fibers was between 2 to 3% by weight. To prevent fiber clumping, it was necessary to maintain the forming environment at conditions of high humidity by the external circulation of humid air.

EXAMPLE II

The air laid line above described was outfitted with temperature control means 25 of FIG. 2, and a humidifier was installed upstream of the hammermill. Pulp feed rate to the hammermill was maintained at 2.7 lbs./min., and the recycle stream was maintained at 400 ACFM, 80° F. and 50% R.H. However, 70 ACFM of make-up air at 195° F. and 90% R.H. was introduced into the hammermill from the humidifier. This air contributed 1.8281 lbs. water vapor/min. to the process, the total water concentration in the hammermill being 2.3314 lbs./min. This value is more than four times the water concentration of Example I.

Leaving the hammermill the air temperature was 191° F. and the R.H. was 6.62%. The air flow rate was 556.70 ACFM. The in-line temperature drop was 51° F. to 140° F., and the R.H. just before the forming header was 50.4%. Note that the heat control means 25 did not have to be used inasmuch as the temperature drop did not result in condensation. The air stream flow rate was 512.4 ACFM, and the fiber moisture content was measured at above 5% water by weight. Clumping was largely avoided even though the forming environment was not maintained by external humid air circulation.

It is to be understood that the above description is exemplary of the invention, and is not to be construed as limiting, the scope of the invention being as defined in the appended claims.

I claim:

1. A method of forming an air laid fibrous web, the method comprising the steps of defiberizing a bulk source of cellulosic fiber in a defiberizer; transporting the defiberized fibers pneumatically to a forming header, the transport medium having a relative humidity as measured just upstream of the forming header, the relative humidity being below saturation but sufficiently high to preserve an average moisture content of the fibers to be laid at least above 2.5% by weight, the defiberizer having a relative humidity corresponding thereto as adjusted for differences in operating conditions, and dispensing said fibers from the forming header onto a foraminous support means, whereby the fibrous web is formed.

2. A continuous method of forming an air laid fibrous web, the fibers to be laid into the web having an average moisture content of at least about 2.5% by weight, the method comprising the steps of feeding to a defiberizer simultaneously a bulk source of cellulosic fiber having a moisture content of between about 4 and 10% by weight, a fiber free, moisture laden, unsaturated air stream having a temperature between about 150° to about 200° F. and a relative humidity in the range of 75% to 95%, and a stream of fiber containing air at approximately ambient temperature and between 35 and 65% relative humidity, said fiber containing air having between 0.001 and 0.01 pounds of fiber per actual cubic feet per minute, the ratio of fiber free air to fiber containing air being between 1:12 and 1:5 on an actual volume basis; defiberizing in the defiberizer the fibers from the bulk source of cellulosic fibers and the fibers from the stream of fiber containing air, said defiberizer operating at a temperature of from about 150° to about 210° F.; then transporting said defiberized fibers pneumatically with the defiberizer air feeds to a forming header, the relative humidity just upstream of the forming header being below saturation but sufficiently high to preserve the average moisture content of the fibers to be laid at a level at least above 2.5% by weight, the relative defiberizer humidity corresponding thereto as adjusted for differences in operating conditions; dispensing said fibers from the forming header to form said web, and withdrawing oversized fibers from the forming header for return to the defiberizer in the fiber containing air stream.

3. The method of claims 1 or 2 wherein the relative humidity of the transport medium just upstream of the forming header is proximate to the equilibrium relative humidity at process conditions corresponding to the stated fiber moisture content.

4. The method of claim 3 wherein the fiber moisture content to the forming header is at least 3.5% by weight.

5. The method of claims 1 or 2 wherein the relative humidity of the transport air just prior to the forming header is at least 30%.

6. The method of claim 5 wherein the temperature of the fiber transport air just upstream of the forming header is between 110° and 160° F.

7. The method of claim 6 wherein the fiber transport air temperature just upstream of the forming header is maintained at a fixed value by external heat transfer means.

8. The method of claim 7 wherein the fiber transport air relative humidity just upstream of the forming header is at least 45%.

9. The method of claim 1 further comprising the step of pneumatically transporting oversized comminuted fibers from the forming header to the defiberizer as recycle, the transport medium being humidified air.

10. The method of claim 9 wherein the recycle air provides said sufficient relative humidity such that the fibers are preserved at the requisite moisture content.

11. The method of claim 9 further comprising the step of adding a fiber free, unsaturated, moisture laden stream of air to the defiberizer to provide said sufficient relative humidity such that the fibers are preserved at the requisite moisture content, the air stream having been preheated in a humidifier to about defiberizer operating temperature.

12. The method of claim 11 wherein the temperature in the defiberizer is between 150° and 210° F., the relative humidity of the fiber free air to the defiberizer is between 75 and 95%, and the temperature of said fiber free air is between 150° and 200° F.

13. The method of claims 2 or 12 wherein the fiber moisture content to the forming header is at least 4.5% by weight.

14. The method of claim 13 wherein the relative humidity of the recycle transport air is between 35 and 65%, and the temperature is between 60° and 100° F.

15. The method of claim 13 wherein the relative humidity just upstream of the forming header is maintained by adjustment of the moisture content of said fiber free air to the defiberizer.

16. In a method of forming air laid fibrous webs having the steps of defiberizing wood fibers in a defiberizer, pneumatically transporting said defiberized fibers to a forming header, and dispensing said fibers onto a moving foraminous support means to form the web, the improvement comprising the step of maintaining the relative humidity in the defiberizer and transport line sufficiently high to ensure that the moisture content of the fibers to be laid is at least 3.5% by weight when laid, said relative humidity being below 100%.

17. An apparatus for forming an air laid fibrous web comprising:

(a) a defiberizer having an inlet for fiber from a source of bulk cellulosic fiber to be defiberized into fibers, and an outlet for the fibers;

(b) means for producing and applying to the fibers in the defiberizer a fiber-free, moisture-laden, unsaturated air stream having a temperature and a relative humidity sufficient to produce and maintain an average moisture content above 2.5% by weight of the fibers;

(c) pneumatic transport means for transporting the humidified fibers from the outlet of the defiberizer to a fibrous web-forming head;

(d) means for adjusting the relative humidity of said fiber-free, moisture-laden, unsaturated air stream;

(e) relative humidity sensing means located just upstream of the forming head to provide adjusting signals to said adjusting means; and (f) fiber-dispensing means for dispensing the fibers from the forming head onto a foraminous support.

18. An apparatus according to claim 17 wherein the defiberizer is a hammermill.

19. The apparatus of claim 18 in which the moisture-laden air stream producing and supplying means comprises:

a jacketed tank including means for supplying cooling water to the jacket of the tank;

means for supplying ambient air to the interior of said water-jacketed tank and for transporting moisture-laden air from said water-jacketed tank to said defiberizer;

steam supply means for supplying a controlled amount of saturated steam to the interior of said water-jacketed tank; and condensate discharge means for removal of condensate from the interior of said tank.

* * * * *